US009928981B2

(12) United States Patent
Elberbaum

(10) Patent No.: US 9,928,981 B2
(45) Date of Patent: Mar. 27, 2018

(54) APPARATUS AND METHOD FOR POWERING A COIL OF LATCHING RELAYS AND HYBRID SWITCHES

(71) Applicant: Elbex Video Ltd., Tokyo (JP)

(72) Inventor: David Elberbaum, Tokyo (JP)

(73) Assignee: ELBEX VIDEO LTD, Tokyo (JP)

( * ) Notice: Subject to any disclaimer, the term of this patent is extended or adjusted under 35 U.S.C. 154(b) by 0 days.

(21) Appl. No.: 15/171,339

(22) Filed: Jun. 2, 2016

(65) Prior Publication Data

US 2017/0352512 A1 Dec. 7, 2017

(51) Int. Cl.

| | |
|---|---|
| ***H01H 9/20*** | (2006.01) |
| ***H01H 50/32*** | (2006.01) |
| ***H01H 50/14*** | (2006.01) |
| ***H01H 50/56*** | (2006.01) |
| ***H01H 50/04*** | (2006.01) |

(52) U.S. Cl.

CPC ..... *H01H 50/32* (2013.01); *H01H 50/04* (2013.01); *H01H 50/14* (2013.01); *H01H 50/56* (2013.01); *H01H 2235/01* (2013.01)

(58) Field of Classification Search

CPC ..... H01H 51/06; H01H 51/32; H01H 50/02; H01H 50/14; H01H 50/16; H01H 50/58; H01H 50/326; H01H 50/443; H01H 3/60; H01F 7/14081; H01F 2007/086

USPC ..... 335/171

See application file for complete search history.

(56) References Cited

U.S. PATENT DOCUMENTS

| | | | | |
|---|---|---|---|---|
| 5,923,363 | A | 7/1999 | Elberbaum | |
| 6,441,707 | B2 * | 8/2002 | Swartzentruber | H01H 51/01 335/132 |
| 6,603,842 | B2 | 8/2003 | Elberbaum | |
| 6,940,957 | B2 | 9/2005 | Elberbaum | |
| 7,461,012 | B2 | 12/2008 | Elberbaum | |
| 7,639,907 | B2 | 12/2009 | Elberbaum | |
| 7,649,727 | B2 | 1/2010 | Elberbaum | |
| 7,864,500 | B2 | 1/2011 | Elberbaum | |
| 7,973,647 | B2 | 7/2011 | Elberbaum | |
| 8,041,221 | B2 | 10/2011 | Elberbaum | |
| 8,117,076 | B2 | 2/2012 | Elberbaum | |
| 8,148,921 | B2 | 4/2012 | Elberbaum | |

(Continued)

OTHER PUBLICATIONS

U.S. Appl. No. 15/073,081, filed Mar. 17, 2016.

*Primary Examiner* — Shawki S Ismail
*Assistant Examiner* — Lisa Homza
(74) *Attorney, Agent, or Firm* — Stern & Schurin LLP

(57) ABSTRACT

Apparatus and method for latching one pole contact of at least one springy pole in a relay or hybrid switch for maintaining an engaging or disengaging state of at least one first contact or at least one second contact with said pole contact by a mechanical latching device comprising a springy lock pin exerting minute force, a slider with indentation path for guiding the lock pin and a track for the slider, the latching device extends from an armature or the springy pole to a base or a body of the relay or the hybrid switch, said springy pole is guided by said slider movement propelled by one of a pull by a voltage rated magnetic coil fed by a pulse of said rated voltage and a push by a plunger, and for operating a stronger coil for switching higher electrical current the magnetic coil is fed with at least one discharge higher voltage to increase the magnetic pull power of the coil.

24 Claims, 5 Drawing Sheets

(56) References Cited

U.S. PATENT DOCUMENTS

| | | | | |
|---|---|---|---|---|
| 8,170,722 | B1 | 5/2012 | Elberbaum | |
| 8,175,463 | B2 | 5/2012 | Elberbaum | |
| 8,269,376 | B1 | 9/2012 | Elberbaum | |
| 8,331,794 | B2 | 12/2012 | Elberbaum | |
| 8,331,795 | B2 | 12/2012 | Elberbaum | |
| 8,340,527 | B2 | 12/2012 | Elberbaum | |
| 8,344,668 | B2 | 1/2013 | Elberbaum | |
| 8,384,249 | B2 | 2/2013 | Elberbaum | |
| 8,442,792 | B1 | 5/2013 | Elberbaum | |
| 8,489,469 | B1 | 7/2013 | Elberbaum | |
| 9,036,320 | B1 | 5/2015 | Elberbaum | |
| 9,219,358 | B2 | 12/2015 | Elberbaum | |
| 9,257,251 | B2 | 2/2016 | Elberbaum | |
| 9,281,147 | B2 | 3/2016 | Elberbaum | |
| 9,437,375 | B2 * | 9/2016 | Kuo | H01H 9/24 |
| 2015/0187528 | A1 * | 7/2015 | Elberbaum | H01H 51/27<br>361/195 |

* cited by examiner

FIG. 1A
Prior art
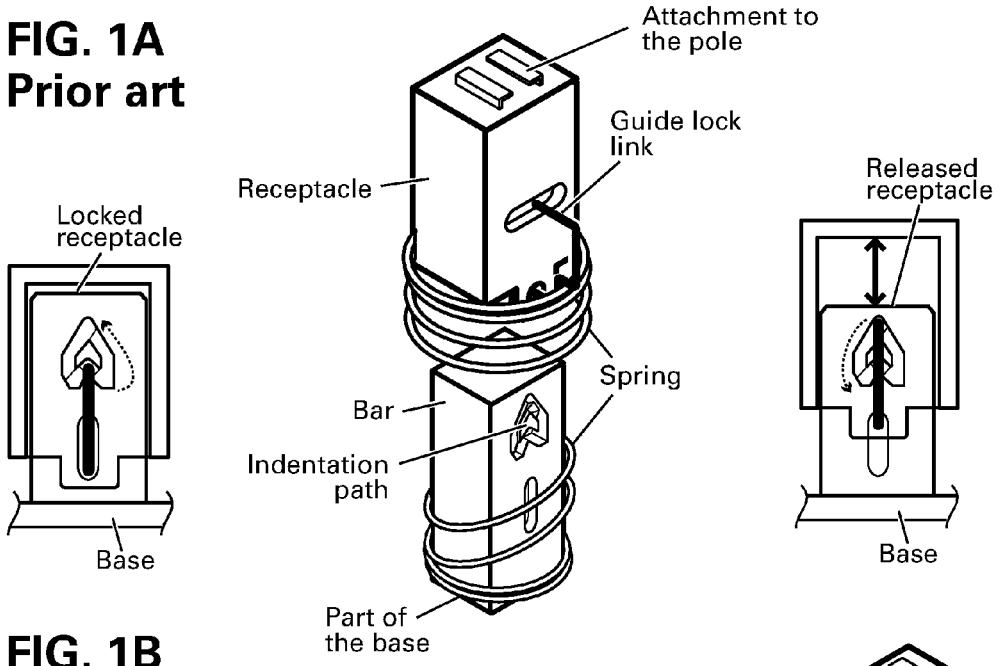
FIG. 1B
Prior art
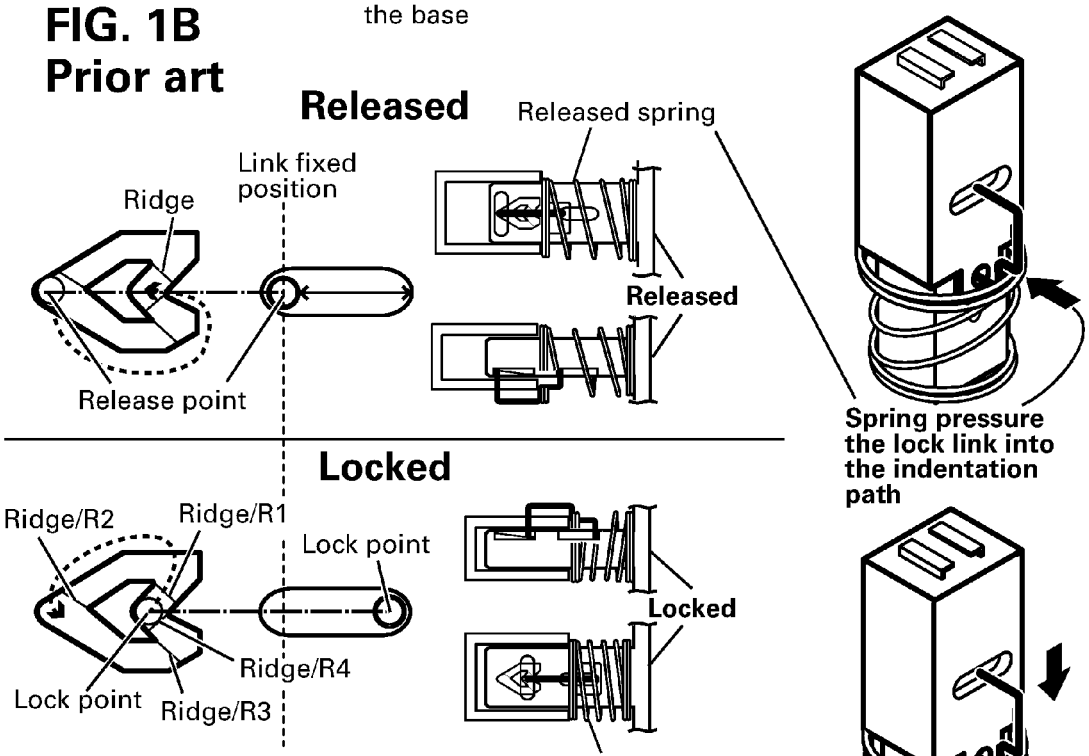
FIG. 1C
Prior art

FIG. 2A
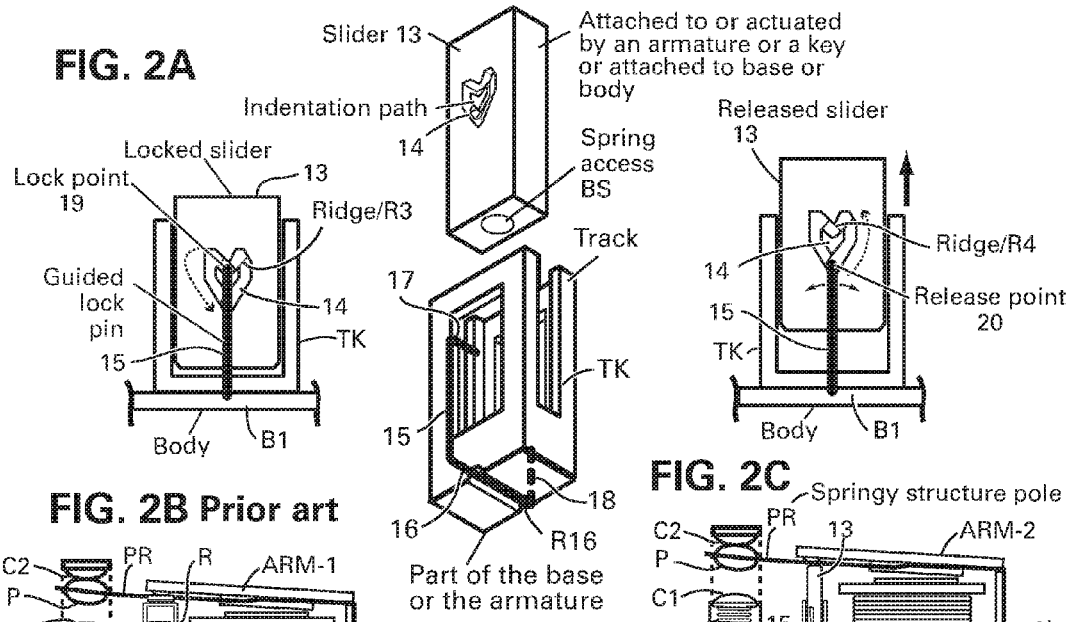
FIG. 2B Prior art
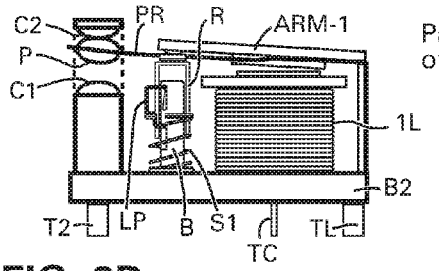
FIG. 2C
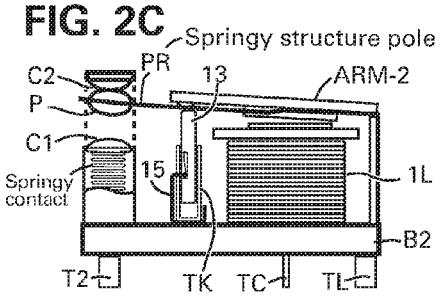
FIG. 2D
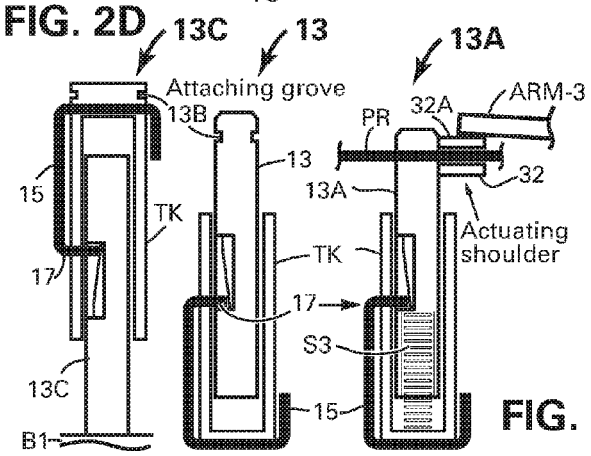
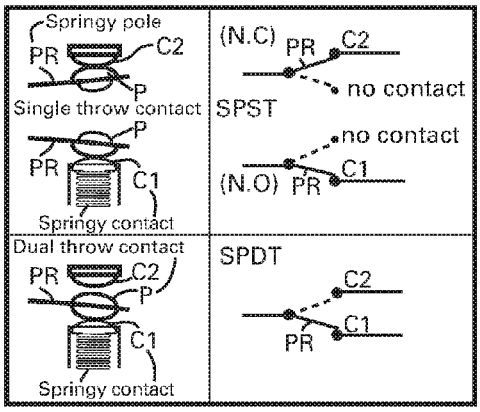
FIG. 2E
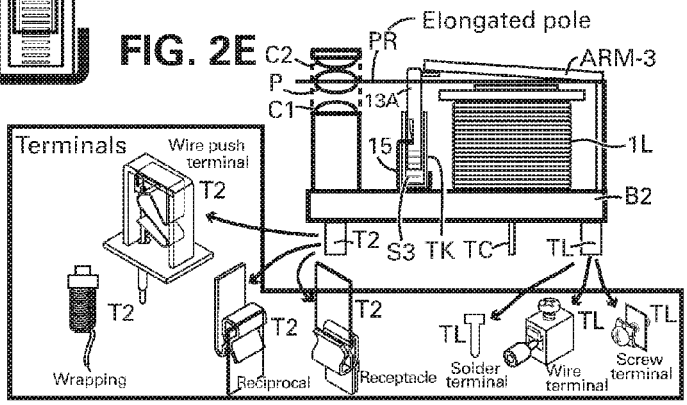

FIG.3A
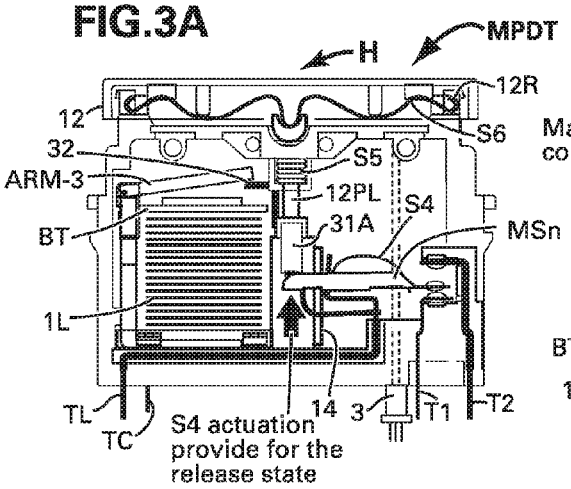
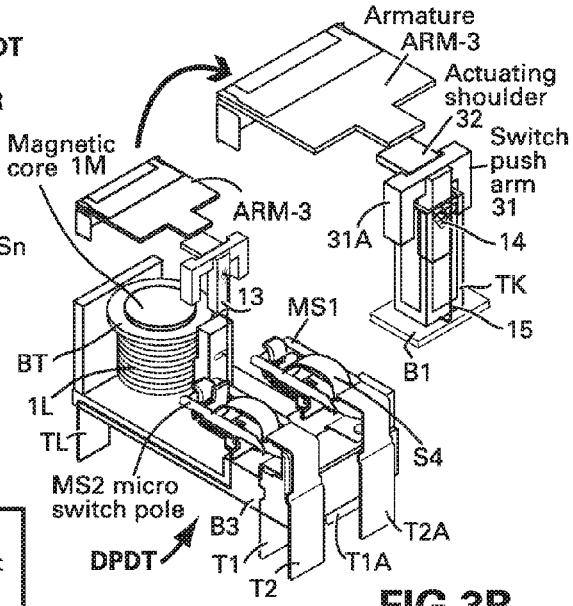
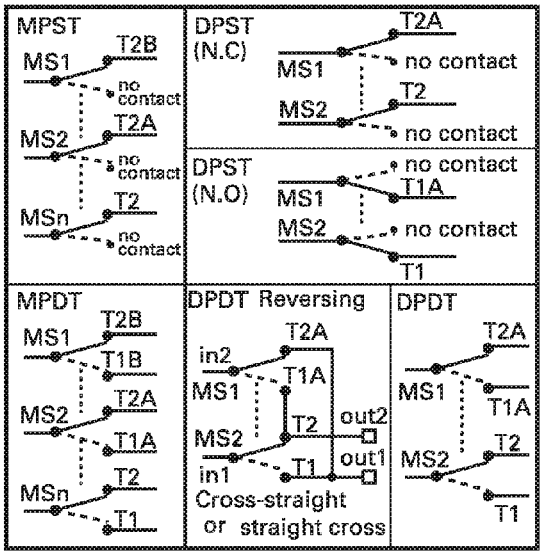
FIG.3B
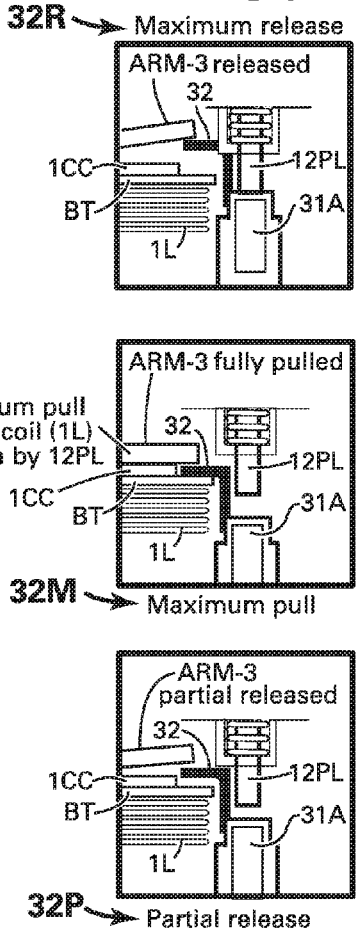
FIG.3C
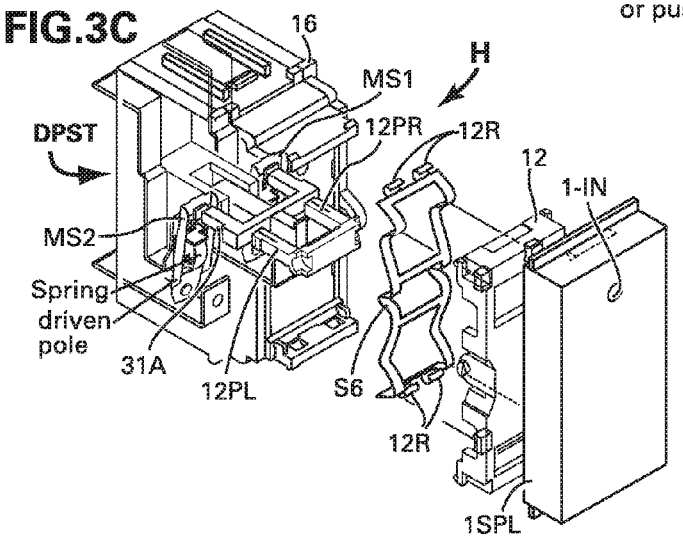

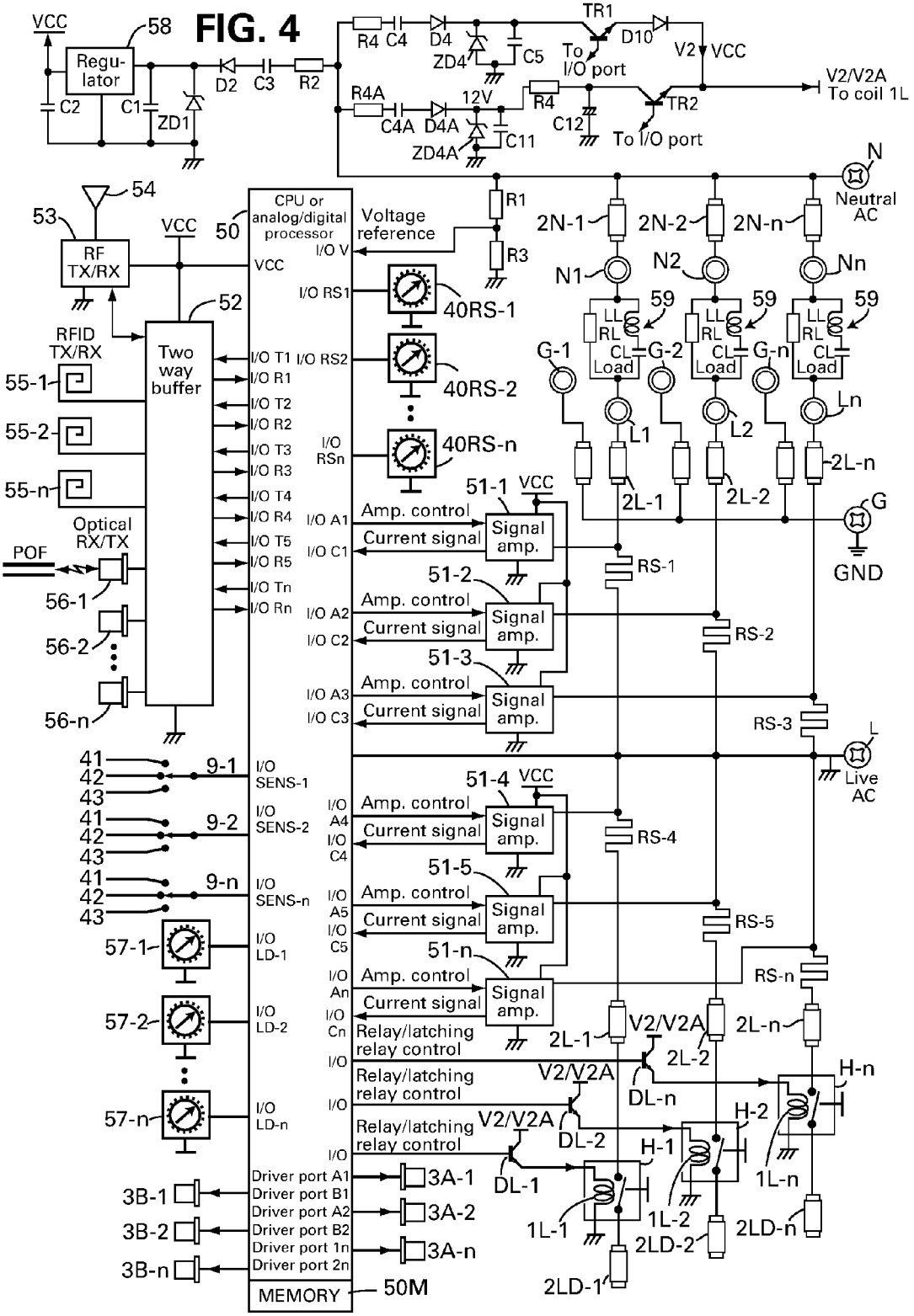
FIG. 4
VCC
58
Regu-lator
C2
C1
ZD1
D2
C3
R2
R4 C4
D4
ZD4
C5
TR1
D10
To I/O port
V2
VCC
V2/V2A To coil 1L
R4A
C4A
D4A
12V
ZD4A
C11
R4
C12
TR2
To I/O port
N
Neutral AC
54
53
RF TX/RX
VCC
50
CPU or analog/digital processor
Voltage reference
R1
R3
2N-1
2N-2
2N-n
N1
N2
Nn
52
Two way buffer
RFID TX/RX
55-1
55-2
55-n
Optical RX/TX
POF
56-1
56-2
56-n
I/O V
I/O RS1
40RS-1
I/O RS2
40RS-2
I/O RSn
40RS-n
59
LL
RL
CL
Load
G-1
G-2
G-n
L1
L2
Ln
2L-1
2L-2
2L-n
G
GND
51-1
51-2
51-3
51-4
51-5
51-n
Amp. control
Current signal
Signal amp.
I/O A1
I/O C1
I/O A2
I/O C2
I/O A3
I/O C3
I/O A4
I/O C4
I/O A5
I/O C5
I/O An
I/O Cn
RS-1
RS-2
RS-3
RS-4
RS-5
RS-n
L
Live AC
41
42
43
9-1
9-2
9-n
I/O SENS-1
I/O SENS-2
I/O SENS-n
57-1
57-2
57-n
I/O LD-1
I/O LD-2
I/O LD-n
Relay/latching relay control
V2/V2A
DL-1
DL-2
DL-n
H-1
H-2
H-n
1L-1
1L-2
1L-n
2LD-1
2LD-2
2LD-n
3B-1
3B-2
3B-n
Driver port A1
Driver port B1
Driver port A2
Driver port B2
Driver port 1n
Driver port 2n
3A-1
3A-2
3A-n
MEMORY
50M

APPARATUS AND METHOD FOR POWERING A COIL OF LATCHING RELAYS AND HYBRID SWITCHES

BACKGROUND OF THE INVENTION

1. Field of the Invention

This invention is related to powering of magnetic coils used to actuate mechanical latching hybrid switches and relays and for reducing the needed force to operate the mechanical latching.

2. Description of the Prior Art

Switches and relays for switching on-off electrical appliances such as water boiler, air conditioners, heaters, lights and any other electrical equipment and appliances in residences, offices, public building, businesses, restaurants and factories are very well known. The well known relay devices for home automation are commonly installed in the main or a sub electrical cabinet of a given premises. The installed relays are operated via bus lines, RF, or by control signal propagated via the AC power line.

The costs of the prior known automation devices and relays including their installation are very high because the electrical wiring must be changed from its standard commonly applied wiring systems, in which the electrical power is fed via the commonly installed switches in the electrical wall boxes. This is in clear contrast to the electrical direct feed from the main or sub electrical cabinet via the relays.

For controlling the relays in the electrical cabinets, the commonly used standard switches are replaced by control switches, propagating electrical signals, RF signals, AC power line signals and in some instances IR signals in open air to reach and operate the relay's control circuits in the electrical cabinets.

Such fundamental basic change in the structured electrical systems became too complex, costly and moreover the complexity is the cause for serious repeated malfunctions of the installed electrical automation systems. Further, the known home automation devices do not report the power consumed by the individual electrical appliances and do not provide usable data for reporting statistics to the home owners, nor to the yet to be born "smart grid".

The U.S. Pat. No. 7,649,727 introduced a new concept whereby single pole dual throw (SPDT) relay connected to a commonly used SPDT switch or dual poles dual throw (DPDT) switch enabling to switch the electrical appliances or lights manually via the commonly installed switch and remotely via the home automation controller. The SPDT and DPDT switches are known also as two way, four way or cross-straight switch respectively.

Further, the U.S. Pat. Nos. 7,639,907, 7,864,500, 7,973,647, 8,041,221, 8,148,921, 8,170,722, 8,175,463, 8,269,376, 8,331,794, 8,331,795, 8,340,527, 8,344,668, 8,384,249 and 8,442,792 disclose home automation controls, connections, switches and relays for operating electrical appliance via the devices being an add on device such as the SPDT and DPDT relays or current drain adaptors. U.S. Pat. Nos. 9,036,320, 9,257,251 and 9,281,147 particularly disclose latching relays and hybrid switches.

The referenced US patents further disclose in details the reporting of the power consumed by the appliances through the relays or through AC outlets and plugs or through the current drain adaptors. The current drain or power consumption reports are communicated via optical signals through plastic optical fiber cables known as POF or lightguide, via IR or RF in open air, and via electrical signals through bus lines or other networks directly or via command convertors.

The above listed US patents and pending applications in other countries disclose an add on or a combination of separate SPDT or DPDT switches and/or power sockets and/or current sensing adaptor combinations, which all teach substantially advanced residence and other building automation.

Yet, there is a need for a single automation device comprising a combination of an hybrid switch and a relay that are structured within the sizes and shapes of current day commonly used AC switches at a lower cost than current day automation devices and further providing installation ease and simplicity.

The one issue affecting the size and efficiency of the latching relay or hybrid switch is the magnetic coil pull power and the latching device needed power to compress a spring of the mechanical guide termed lock link, and its pin movement withing an indentation path and ridges in the latch and the release movements of the relay or the hybrid switch as disclosed further below.

Another U.S. Pat. No. 9,219,358 disclose an intelligent support boxes for measuring and reporting the power consumed by the relays, switches and hybrid switch that are attached to the intelligent boxes by a simple push to attach, reducing substantially the switch installation time and cost, which calls for a structured Hybrid switches, relays and switches to be fit for installation into electrical intelligent support boxes, which is another objective of the present invention.

The U.S. patent application Ser. No. 15/073,081 discloses keys for actuating the hybrid switches manually including the actuating of micro switch poles with a latching structure of the present invention, but without disclosing the latching structure particulars.

SUMMARY OF INVENTION

The main object of the present invention therefore is to provide for a small size combination of SPST, SPDT, DPST, DPDT, MPST or MPDT hybrid switches and relays, constructed to be similar to a shape and a size of a commonly used AC switch, referred to hereafter as a "standard AC switch", that is mounted into a standard electrical wall box, such as the known 2×4" or 4×4" wall boxes in the US, or such as 60 mm round European electrical wall box or other rectangular electrical boxes as used in Europe for installing plurality of standard AC switches and AC outlet/sockets.

Another object of the present invention is to integrate the combined switch, combining the AC SPDT or DPDT switch with an SPDT relay and with power consumption calculation circuit of an intelligent wall box. The combined switch refer to hereafter and in the claims as a "hybrid switch", is used for, among other applications, in residence automation system disclosed in the referenced US patents and patent application.

For controlling the hybrid switch and for reporting the power consumed via the hybrid switch the disclosed video interphone system or a shopping terminal and/or via a dedicated automation controller or control station are provided. The video interphones are disclosed in U.S. Pat. Nos. 5,923,363, 6,603,842 and 6,940,957, the shopping terminals are disclosed in U.S. Pat. Nos. 7,461,012, 8,117,076 and 8,489,469.

The need to reduce electrical power consumption is another reason to minimize the use of many relays that consume power for self-operating and control. Many relays installed in a residence or in a shop, or in a factory, or in public facilities persistently drain current and consumed power, thus when many such automation system are installed the overall consumed power will be substantial.

Latching power relays, using dual magnetized armatures or poles or other structured magnetic element are expensive and requiring complex circuitry and programming to control. Moreover, most of the magnetic latching relays can provide for limited current drain, because of the limited magnetic power for tightly engaging the relay contacts, such as maximum 8 Ampere which is below the commonly used AC switches for lighting as an example, that are provided with 16 A as standard.

Magnetic latching relays are operated by a short power pulse and lock or latch into on or off (SPST) or use dual poles for change over state SPDT relays. After engaging the contacts the coil is no longer consuming power and the poles are magnetically latched into position. Magnetic power is declining over time, to eventually deteriorate the contacts surface and eventually fail.

A small power consuming coil for integration into a mechanically latched hybrid switch, such as disclosed in U.S. Pat. Nos. 9,219,358, 9,257,251 and 9,281,147 and for controlling the hybrid switch remotely and efficiently is needed and is the main objective of the present invention.

The other practical objective attained is disclosed in the U.S. patent application Ser. No. 15/073,081 providing the hybrid switches with a structure that can be fitted with different key levers and the freedom to select any from the wide variety of levers and decorative covers and frames including variety of design and colors that are available and are being regularly introduced to the construction/electrical industry by the different switches manufacturers.

Four types of switches for AC appliances and light fixture are commonly used; a single pole-single throw (SPST) and a single pole-double throw (SPDT) switch. The SPST switch is a basic on-off switch and the SPDT is a change over switch. The SPDT switches are used for on-off switching of a given appliance such as light fixture from two separate positions, such as from the two entrances of the same hall or a room.

In instances were three or more switches are needed to switch on-off the same light fixture of a given hall or room, another type of dual pole-dual throw (DPDT) switches are used. The DPDT switch or plurality of switches are connected in a given straight-cross configuration in between the two SPDT switches described above. The DPDT switches are also known as "reversing" switches.

As will be explained later, the two SPDT switches including the one or more DPDT switches connected in a continuous traveler configuration provide for each individual switch to operate on its own, regardless of the other switches status. Therefore any of the switches that are connected in such SPDT and/or DPDT setup configuration will switch on and off the light fixture irrespective of the other connected switches status.

This further means that there is no specific on or off position for any of the key levers of the connected switches, and the switching on or off is achieved by the pushing of the switch lever to its opposite position, or by pushing a push on-push off key.

Accordingly the object of the present invention is to provide hybrid switch comprising an SPDT relay for connection to an SPDT or DPDT manual switch having the same decorated keys and frames and are connected for operating a light fixture or other electrical appliance, thereby maintaining the operation via a "commonly used" manual switch and provide remote switching via the coil of a single SPDT hybrid switch, or for operating the light fixture via a chain of DPDT and SPDT switches as commonly used and provide the same remote switching by introducing a cross-straight DPDT relay into the traveler lines chain, or by connecting a single SPDT hybrid switch at one end of the traveler line. Connecting four way DPDT relay for remotely switching on-off light fixture or other electrical appliance that are connected to manual SPDT switches and to a more comprehensive switching setup that includes two SPDT and one or more DPDT switches substantially improve the lighting control of entrances and staircase of residential or office building, using a single latching SPDT (two way) hybrid switch or relay, remotely operated, in a base floor by a controller, with all other floors are each manually operated by a manual DPDT (cross-straight) switch with the last switch terminating the travelers line is an SPDT (two way) switch.

The reference to a controller above is a controller for receiving commands and transmitting data fed via a communication network selected from a group comprising of wired network such as bus line, optical network or grid of optical cables, two way IR network, RF wireless network and combinations thereof for operating remotely the different latching hybrid switches and relay of the present invention.

The transceiver of the hybrid switch included in the intelligent support box communicates at least one way of two way or bidirectional signals with the home automation controller, the video interphone or the shopping terminal. The transceiver and the CPU are programmed to respond to a power-on command to the connected appliance with a reply that a power-on is acknowledged, or respond to an inquiry pertaining status, current drain and the power consumed by the appliance, thereby updating the home automation controller, or said video interphone or the shopping terminal described in above referenced US patents, or respond with "off status" if the command was to switch off the appliance.

The reference to home automation controller hereafter is to a display device with control keys, touch icons or touch screen and circuits similar to the video interphone and/or the shopping terminal disclosed in the applications and the US patents referred to above.

The terms "hybrid switch" and "hybrid switch relay" hereafter and in the claims refers to the integrated combinations selected from a group of SPDT relay, DPDT relay, DPDT reversing relay with SPDT switch, DPDT switch and reversing DPDT switch of the preferred embodiment of the present invention.

The term "SPDT hybrid switch" refers to a stand-alone switching device for operating a given load manually and remotely.

The term "DPDT hybrid switch" refers to a stand-alone switching device for operating a load in a wet or humid environment, such as bath room or laundry area by switching manually and remotely the two poles of a load, namely the live AC and the neutral AC.

The terms "reversing hybrid switch", "crossing hybrid switch" and "reversing DPDT hybrid switch" refer to a switching device for a given load that is switched on-off via the reversing hybrid switch and via at least one SPDT switch and/or via an intermediate n DPDT switches all connected in a cascaded chain of dual traveler lines, with each of the connected switches can operate the given load, or switch it on-off.

The major objective of the present invention is the use of mechanical latching structure, similar to the disclosed latching structure for the push-push or push-release switch explained later in the description of the preferred embodiment.

The mechanical latching structure provides added contact pressure, enabling the use of small relay coils for operating appliances with an AC current drain of 20 A and more, in both, the latching of the on state or the off state.

It should be noted that in both states no power is fed to the relay coil, and in either state the load can be or is powered through the traveler terminals of the SPDT or DPDT latching relays or the hybrid switches and/or directly fed via the SPST (single pole single throw) and/or the otherwise known as on-off switch or relay or the hybrid switches of the present invention.

The other major objective is the reduction of the force extended onto the latching slider to latch, partial release and full release movements shown in the drawings and explained in detail later. The latching bar as referred to in the disclosed US patents is termed in the present application a "slider" as used for the latching of the pole into a contacting positions, is made to be released by a lesser pushing force, be it for the movements from the fully attracted armature state of the prior art, or otherwise from the disclosed force applied in the above US patents.

This movement causes movement between the two contacts, the pole contact and one of the dual contacts of SPDT relay. The slight movement by the micro switch pole can provide a "brushing effect" for removing electrical blemishes from the surface of the contacts. However, such movement may create contact pressure variations which must be minimized to ensure that current carrying capacity is not affected by the inter contact movements.

The decision to provide an extended "bending" poles or spring activated contacts including the contacts of the pole itself are a design choice and are the other objectives to provide smooth trouble free latching mechanisms, all of which cover the other preferred embodiments of the present invention.

The terms "springy element", "springy lock pin" and "springy pole" refers hereafter and in the claims to a bending and/or flexing elements and parts, or to a pole or a pin that is bending and flexing or to a pole that is structured for providing spring like contact, or to a pole comprising a spring such as micro switch pole, or to a pole driven by a spring, or to an electrical contact driven by a spring, or to a contact comprising a spring, or to a contact structured into a spring like element and any combinations of a spring or structure associated with a pole, the lock pin and the contacts of a latching relay and/or the hybrid switch that exerts small or minute force for guiding the lock pin and pushing the slider during the release movement from the latching state. Minute force refers hereafter and in the claims to a push force such as a range of approximately 0.1-0.2 Newton and below, or a push force of below 10 gr. and/or approximately between 10-20 grams.

The term latching device refers to a structured element such as a bar or a slider having the indentation path and ridges driving the latching pin of the guided lock pin between a latch position to a release position by being compressed by the armature or by a manual push element against a given spring and/or by a springy pole or a spring of a pole, such as the spring of a micro switch pole, or being a structured into a springy pin such as a springy lock pin for self exerting the push force during the alternating movements by the slider onto the latching path, i.e., from latch to partial release and from partial release to full release state.

The term alternate hereafter and in the claims refers to reversing of the latching state from latch to release as applied to engage and disengage the pole contact with one or the other pole.

The guide lock link disclosed in the U.S. Pat. Nos. 9,219,358, 9,257,251 and 9,281,147 is a rigid structured pin pushed by a spring into the indentations of the latching bar or as presently termed slider.

The same spring is used for pushing the bar away from the receptacle into a release position. The dual purpose spring uses force for its operation and mandates bigger magnetic coils, consuming higher electrical power for actuating the relay or the hybrid switch.

Accordingly, the other main objective of the present invention is the reduction of the mechanical force needed to operate the latching slider and thereby enable to further reduce the coil size and simplify the mechanism for the latching and the release actions, operating the mechanical latching relays and/or hybrid switches by a smaller relay coil, known also as magnetic coil. The reduced coil consumes less electrical power.

The other objective is obtained by; first using smaller and thinner slider with indentation and ridges to provide the guided lock pin the movements between the latching point, the partial release and the release actions.

The second is to use a springy guided lock pin that is self providing the springy pressure for its pin into the indentation path and ridges; and the third is the use the pole springy power to release the slider and the guided lock pin by attaching to or actuating the slider by the pole or the armature, or provide a very low force spring for the full release action disconnected from the pole, be it from partial release for a slider that is actuated by the armature via an actuating shoulder, thereby removing power consuming item from the latching mechanism, and reducing substantially the needed electrical power to the coil for magnetically attracting the armature to start with.

The other solution for attaining the present objectives for reducing the force applied by the coil is the use of the compressed spring of the micro switch pole or poles for the release movements of the slider from its partial release state and for simplifying the entire hybrid structure by using no further springs, outside the pole springy action or spring, and the springy guided lock pin with the use of a simplified slider with shoulder for actuation by the armature and/or by manually pushed key.

The use of controlled power feed as disclosed in yet another preferred embodiment of the invention attained by exponential discharging electrical power to the coil, from a large capacitor charged with higher voltage and current capacity than the rated coil as used, by applying an exponentially diminishing voltage and current as the armature closes the air gap between the magnetic coil core and the armature, for a time duration of given milli seconds, in line of the speed of the armature being pulled to the magnetic core, accelerated and self adjusted with the application of a discharged electric power down to the rated coil power, followed by applying the rated coil power to stabilize the armature and remove any bouncing, chattering or jittering during the latching and in the release processes.

BRIEF DESCRIPTION OF THE DRAWINGS

The foregoing and other objects and features of the present invention will become apparent from the following description of the preferred embodiments of the invention with reference to the accompanying drawings, in which:

FIGS. 1A~1C are illustrated latching device elements of the prior art disclosed in U.S. Pat. No. 9,257,251, showing the use of dual purpose spring to pressure a guide lock link onto a latching indentation path and ridges and further pressure is extended while compressing the spring and the latching device as used for the latching relay or an hybrid switch;

FIG. 2A shows a similar latching mechanism of FIGS. 1A~1C, but uses no main spring, outside a springy latching pin that is structure for minimal application of force onto the indentation latching path;

FIGS. 2B-2C show a comparison between the structured latching relay comprising a bar, a receptacle and a spring of the prior art shown in FIG. 2B and a latching slider, a track and a guided lock pin shown in FIG. 2C that operates with minimal extended pressure, with all other elements of both latching relays of FIGS. 2B and 2C are otherwise similar.

FIG. 2D shows three structured latching sliders, one for attachment to a pole shown in FIG. 2C and the other for actuation by a relay pole or armature shown in FIG. 2E. FIG. 2E shows the other slider including a projecting shoulder for actuating the slider by the pole or the armature and with the slider being lightly pressured upward by a low pressure spring for releasing the slider, and the third slider illustrate the reversing of the slider and the track element and function between the relay or switch body and the pole or the armature;

FIG. 3A is a partially exploded view showing a dual pole dual throw (DPDT) micro switch with an actuated latching slider extended with a shoulder and two push arms for actuating and latching the DPDT micro switch poles and to initiate the release position from a partial release state by the coil magnetic pull of the armature;

FIG. 3B is a cut view of an hybrid switch, operated manually by direct push of a key onto the slider arms and remotely by the armature pulled by the coil for actuating the latching slider via the actuating shoulder to latch and release by compression.

FIG. 3C is an exploded view of the hybrid switch of the preferred embodiment of the present invention, showing details of the push key for operating the hybrid switch manually by a finger push.

FIG. 4 is electrical block diagram of the present invention as used in an intelligent support electrical wall box accommodating hybrid switches and latching relays of the prior art as modified for the present invention.

DETAILED DESCRIPTION OF THE PREFERRED EMBODIMENT

Figure 5A:
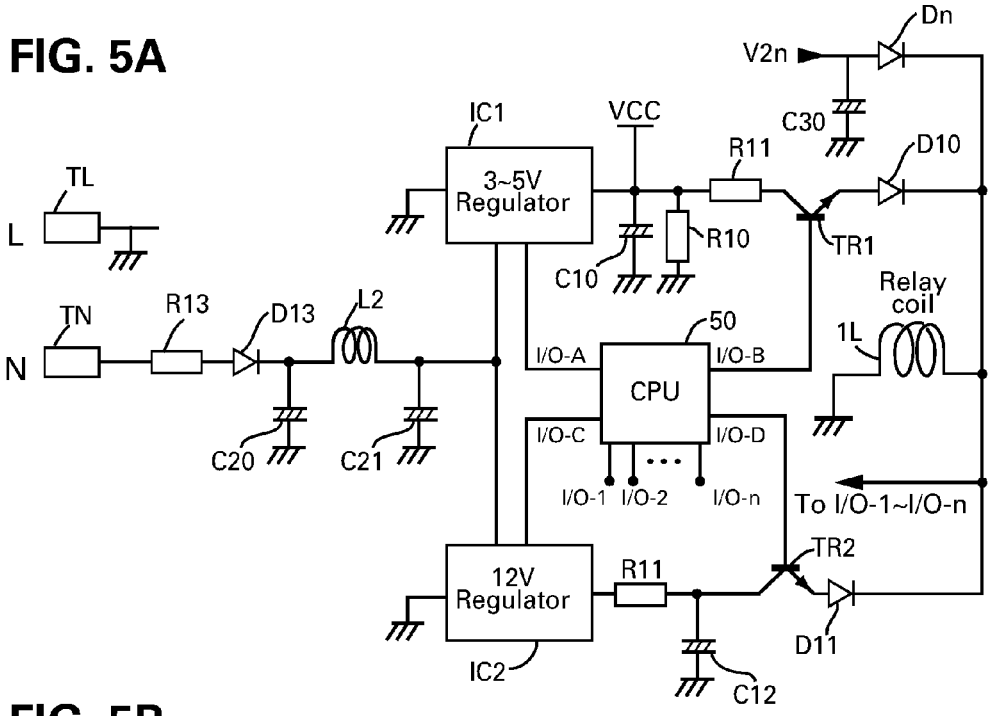
FIG. 5A is a block diagram of the electrical powering circuit of the present invention for actuating the armature by a controlled power feed for providing the magnetic pull needed for the actuation of the latching slider and the micro switch poles or the relay poles of the present invention and shown in FIGS. 2C-3B above.

FIGS. 2*a*1B and 1C show the known lock-release device of the prior art as used for push switches and applied to latching relays and hybrid switches. The lock-release shown is also known as mechanical latching of relays and are shown in the referenced US patents for manual push-keys for a switch and relay combinations. The known mechanism is commonly embedded into a key bar individually and the use of a similar latching structure for latching the SPDT relay pole or dual poles of the DPDT relay was a novel structure for latching a relay pole of the U.S. Pat. No. 9,257,251.

FIG. 1A showing the prior art mechanism, introduced to explain the features created by combining the very simple lock-release to a structure shown in FIG. 2B of the prior art that is attached to the relay pole that is loosely attached to armature ARM-1 of FIG. 2B and to a receptacle R. The receptacle R and the bar B are linked via the rigid guided lock link LP pressured by a released spring S1 while pressuring the lock link LP onto the indentation path.

FIGS. 1B and 1C illustrate in many angles of the spring actions and the movements of the guided lock link between the latch and release positions. FIGS. 1B and 1C clearly illustrate the pressure applied onto the spring to compress and to pressure the guided lock link onto the indentation path and ridges. In practice the pressure applied onto the spring ranges between 0.7~1.2 N (Newton) or between applied forces of 70 gr~120 gr.

The above range is achievable with a coil size known in the relay industry to be 3-4 W power consuming coil, such as 12V DC with 300~350 mA current drain. However such coil mandates a narrow gap between the armature and the coil's magnetic core, such as 1~1.2 mm distance.

For higher power relay operating in the AC power line a gap of 1~1.2 mm is small and the hybrid switch that operates via a coil and via a manual key the gap should be enlarged. However to maintain the hybrid switch size within the sizes of the commonly available switches the 3-4 W coil size cannot be increased.

This mandates a reduction in the physical force applied to compress the bar into the receptacle and onto the indentation path.

FIG. 2A illustrates the molded lock-release indentations of a slider 13. Slider is a term given to the shown slim bar of the present invention and a track TK. The slider 13 with the indentation 14 that provides the path for the guided lock pin 15 and form together with the indentation path and ridges the lock release structure.

One end 16 of the guided lock pin is held in position shown as guided center point R16, with the other end is the pin 17 of the guided lock pin traveling inside the groove or indentation 14 via the opening 34 of the track TK that limits the slider movement to left-right between two positions, shown upwards via the latching path to the lock point 19 and downwards via the release path to the release point 20. The back end of the guided lock pin is traveling along the axis 18 in a pendulum movement between the latch and the release paths of the indentation 14 and is providing the counter support to the small pressure applied by the pin 17 onto the indentation 14.

No spring is used or shown in FIG. 2A, other than the springy guided lock pin.

The guided lock pin 15 is limiting the forward-backward movement of the slider 13 to the length of the indentation 14 and into two positions, the locked position or point 19 and the released position 20. The release point 20 provides for up-down free movements with wide tolerances and it is not a rigid point.

The slider 13 movement within the indentation path 14 is a forced move by a manual push key or the armature ARM-2 or ARM-3 by a pull to lock, and by a spring pressure to release. The spring is discussed further below.

The counter clockwise movement is created by the blocking ridges shown as ridges R1~R3 to unlock and ridge R4 in FIG. 1C of the prior art to lock. The ridges prevent movements in the clockwise direction, with two only stationary points remain, the lock 19 and the release 20 points or positions respectively.

The two positions mechanism recited above, or any other known lock-release mechanism applied to lock or latch a mechanical structure to engage the slider 13 can be used. The shown structure is a preferred low cost mechanism using two moving parts only, the molded slider 13 and the springy guided lock pin 15 as the other part, such simple mechanism is very reliable that never fails in normal use.

As shown in FIG. 2A the distance between the lock and the release positions is within a maximum movement distance shown in FIG. 2A. In practice the movement ranges between 1.5~2.0 mm. Such lock-release movement wherein the armature ARM-2 of FIG. 2C or ARM-3 of FIG. 2E or by a key 12 or 1SPL of the hybrid switch of FIGS. 3B-3C will be locking and releasing the pole by a stroke movement of 1.5~2.0 mm. Such limited stroke is a small stroke that may not be sufficient to operate the SPST or SPDT micro switches MS1 and MS2 of FIGS. 3A~3B, as an example, and the stroke range must be extended. Tolerances are needed to cover the imprecise variation of the micro switches actuated by the spring S4, including the taking into consideration the partial release state discussed further below.

The referred to above modified lock-release mechanism/structure enables to operate hybrid switch combination be it SPDT or DPDT switch with the SPDT relay and provide for two way switching, manual switching via the key 12 of FIG. 3B and/or via a decorative key 1SPL of FIG. 3C and remote switching by operating the SPDT relay through its coil 1L.

A DPST relay or hybrid switch (Dual Poles Single Throw) is needed to replace DPST manual switches used for wet rooms or zones in building and residences for switching on-off the live AC line and the neutral AC line. It is common or an established building/electrical code in some countries that lights, heaters and water boilers in bath rooms or laundry corners, as an example, must be switched on-off via dual pole switches switching on-off the live and the neutral.

Same apply to MPDT relays or hybrid switches that use for example three micro switches setup MS1-MS3 (not shown) instead of the two shown MS1-MS2 to switch over HVAC, that is powered by three phase heavy power lines, from cool to heat actuated by an expanding the switch push arms to three, 31 and 31A shown to include 31B (not shown). Or switch on-off via MPST hybrid switch or relay by removing three terminals T1, T1A (shown) and T1B (not shown).

For such application the present invention is fully compliant with the requirements, codes and rules, and provides the manual and remote actuating of the two AC lines via the two micro switches MS1 and MS2 of FIG. 3A. The shown hybrid switch in FIG. 3A is a DPDT (dual pole dual throw) and the removing of terminals T2 and T2A, as an example, will change the hybrid switch to DPST switching device.

The above introduction of the simplicity in changing a DPDT switch to a DPST switch by removing only two terminals is also to introduce the practical structure of the latching device i.e., the slider with the shoulder and the track shown in FIGS. 3A and 3B.

The well known micro switches are operated by a plunger pushing the pole assembly MS1 or MS2 against the spring S4 force that maintains the pole in its N.C. (Normally Close) state which is the engaging of the poles MS1 and MS2 with the contacts of the shown terminal T2 and T2A. The plunger of the known micro switch that is replaced by the push arms 31 and 31A for pushing "downwards" the poles (as shown) for actuating the spring S4 to flip the pole MS2 shown in FIG. 3B to engage the contact T1.

The reference above to "downwards" is made for explanation, based on the orientation top-bottom or left-right of the drawings. Micro switch and the hybrid switch of the present invention can be and are mounted on wall and the term "downwards", therefore should include a push against a wall. The "downwards" term above suggests or illustrates a push against the normal state, i.e. N.C. or "Normal Close" and the term downwards or upwards hereafter can be read as reversing or alternating the present state to an opposite state.

For electrical switching application the normal state refers to the state in which the device, such a micro switch, is in its resting position, i.e. the spring S4 is not actuated by the plunger or by the push arm 31 or 31A of FIGS. 3A and 3B.

In normal state therefore the pole MS2 shown in FIG. 3A is resting "upwards" against the contact and terminal T2. The switch over of, or to alternate the micro switch to engage the contact of the terminal T1, the plunger of a micro switch or the arm 31A of the slider 13 is pushing downwards the rear end of the pole MS2 and thereby actuating the spring S4 to flip and switch over, reverse or alternate the pole to engage the contact of T1.

This means that the slider 13 and the push arm are in fact the well known plunger used by micro switches, that is pushed upwards by an Hybrid Switch employing the micro switch pole for the mechanical switching. The spring S4 is the spring that flips upwards the rear of the pole and pushes the slider 13 upwards, similar to the springy pole PR of the latching relay shown in FIG. 2C and/or in the pole PR of the prior art of FIG. 2B, that is operated via a plunger (termed a bar in the referenced US patents).

The slider 13 and its arms 31 and 31A are guided by the lock pin between the lock point and the release. The movements as shown in FIGS. 2A and 3B limits the release position upwards to a point of engagement of the shoulder 32 with the released armature ARM-3 shown in 32R of FIG. 3B, pushed upwards by the pole MS2 actuated by the spring S4.

To latch the slider, be it via the manual key 12 and the dual plungers 12PL and 12PR or by pushing the shoulder 32 via the armature ARM-3 all the way to the top surface of the bobbin BT of the coil 1L. The bobbin top BT is the physical limit for the manually pushing or the magnetically pulling the armature for moving the slider shown in 32M of FIG. 3B. The bobbin BT limit however does not guide the lock pin 17 to the lock point 19.

The coordinated limit of down movements by the shoulder 32 and the pin 17 within the indentation path 14, at the engaging point of the shoulder with the bobbin top BT, is for the pin 17 to be guided to pass the ridge/R3 of FIGS. 1C and 2A which leads the pin to a position of the indentation that is higher from the lock point 19 of FIGS. 1C and 2A.

At the time the shoulder is released, i.e., at the end of feeding the power pulse to the coil 1L, or at the time of releasing of the key 12, the slider 13 is pushed upwards by the force of the micro switch spring S4 and the pin 17 to move into the lock point via the ridge/R4 shown in FIGS. 1C and 2A. The locking of pin 17 stops the reverse (upwards) move of the slider 13.

Yet the initial reverse (upwards) move from the BT point to the stop point 19 will result in a partial release of the shoulder 32 from its maximum push position, detaching the shoulder 32 from the bobbin top BT as shown in 32P of FIG. 3B.

The partial release of the shoulder 32 is an absolute necessity for enabling a fresh push, or a pull by the coil 1L, to release the guided lock pin and for the armature to reverse the hybrid switch state with each fresh push or pull. Be it manually via the key 12 or via feeding an electric power pulse to the coil 1L.

If the shoulder 32 is locked onto the top of the bobbin BT of the coil 1L and the pin 17 is locked into the stop point 19, it will be impossible to reverse the state of the hybrid switch that will be locked permanently or "forever". Accordingly the partial release is mandatory state as explained and claimed in the referenced US patents.

It should be clear from the above explanations that the use of the micro switch poles MS1 and/or MS2 with the single or dual micro actuating spring S4 provide for propelling the needed movement of the slider "upwards", i.e. in reverse direction to the push applied onto to the slider (the plunger) to reverse the switch state.

It should also be clear that the only springs used in the shown hybrid switch of FIG. 3B are the springs S4 and the springy guided lock pin 13 that does not represent a meaningful force in the way of a pull by the coil 1L.

FIGS. 2D and 2E show a spring S3 as used with a slider 13A, but not with the slider 13 of FIG. 2C. The reason is simple, slider 13 is attached via the grove 13B to the springy pole PR that is loosely attached to the armature ARM-2, and is moving upwards by the release of the pin 17 from its stop point. Slider 13A of FIG. 2E is actuated by the pole PR or the armature ARM-3 or both and is not attached and therefore the slider 13A cannot be pulled up by the pole.

The slider 13A could be structured with dual shoulders 32 and 32A for push by the pole onto the lower shoulder 32 and be lifted and pulled up via the upper shoulder 32A, or it could be provided with a low force spring S3 as shown for propelling and moving of the slider upwards. Such low force spring to propel and move a very light weight slider (1~2 gr) to a distance of 1.5-2.0 mm is negligible and is not a meaningful force to hinder the power feed to the coil 1L.

It should be clear however that the removal of the compressing spring of the prior art provides clear advantage in the need to reduce the power and the size of the coil to actuate the one or two or more micro switches poles of the present invention.

With all above explained it is necessary to point to the other springs S5 and S6 shown in FIGS. 3B and 3C. Two springs S5 are used to maintain the plungers 12PL and 12PR to be detached from the slider 13 when the key 12 or 1SPL are at their rest position, or the key is not pushed in any way by a finger or otherwise.

Spring S6 is a tactile spring for providing swift push action onto the plungers 12PL and 12PR that are actuated by a finger push throughout the surface of the key cover 1SPL. When the key is in its rest position the spring S6 is detached from the plungers 12PL and 12PR.

FIGS. 3B and 3C illustrate the springs S5 and S6 wherein FIG. 3B shows the spring S6 and S5 compressed when the key 12 is shown pushed for actuating the arms (plungers) 12PL and 12PR for pushing the rear end of the micro switch pole.

When the armature ARM-3 is actuated (fully pulled), released or partially released the spring S5 is shown expanded in the three state boxes 32R, 32M and 32P of FIG. 3B.

Same applies to the spring S6 shown in FIG. 3C, when the key 12 or 1SPL is not depressed the spring is resting all the way upwards, hinged by the two set or rounded edges 12R, detaching the spring and the key away from the plungers 12PL and 12PR.

This clearly shows that the other springs of the hybrid switch and/or the latching relay do not load the coil 1L with any further weight, friction or force to be overcome by the magnetic pull power of the coil 1L.

Another important item to note is the reversing of the track TK and the slider 13C of FIG. 2D. The shown tracks and sliders are shown to be part of or attached to the body B1 or base B2, however there is no difference in the operation of the latching relay shown in FIGS. 2C and 2E if the slider and the track are reversed as shown in FIG. 2D at 13C.

Same will apply to the hybrid switches of FIGS. 3A~3C if the slider and the track are reversed and the push arms are parts of the track and not of slider, the operation of the hybrid switch H will be the same.

FIG. 4 shows an amended block diagram of the electrical and control circuit of an intelligent support wall box for powering and operating n hybrid switches and relays of the present invention.

FIG. 4 also shows an amendment made to the block diagram of the intelligent support box disclosed in U.S. Pat. No. 9,219,358 and further amendment made in the patent application Ser. No. 15/073,075 to include n indicators. The shown LED indicator 3 in FIG. 3C is used for indicating the status of the hybrid switch shown in FIG. 3C via a light guide LG shown in dotted lines in FIG. 3B and via the indicator window 1-IN of the key cover 1SPL shown in FIG. 3C. The single LED 3 of the present application or plurality of indicators 3 such as shown in FIG. 3B can use any of the LED I/O drivers A1~An or B1~Bn as assigned and programmed for the given support box size and combinations, be it for single or plurality of indicators per hybrid switch or relay of the present invention. The amendment to FIG. 4 of the present application is the addition of a DC power line V2A for augmenting the power feed to the coil 1L. The augmented DC power is an higher voltage charged to a large capacitor for discharge by injection into said pulse via a diode at predetermined n milli second after the initial feed of said rated voltage pulse, thereby the coil IL is fed by a combination pulse comprising two different voltages, V2 the rated voltage and V2A a discharged voltage, discharged in exponential pattern.

The amendment in the power supply circuits shows an addition of resistors R4A and R5A, capacitor C4A, rectifier D4A, Zener diode ZD4A and electrolytic capacitor C12 for charging and discharging nV, shown to be 12V DC as an example of the V2A value.

The other addition is the diode D10 connecting the prior disclosed power V2, shown to be 5V as an example to the 12V line. Thereby transforming the power feed line into dual voltages for outputting a power pulse combination comprising the VCC line voltage and discharge higher voltage in a feeding sequence of at least two voltages in succession, by injecting the V2A to the coil 1L as will be explained later.

The output V2/V2A line is connected to the plurality of switching transistors DL-1-DL-n via plug-in connectors (not shown) for powering the coils 1L-1~1L-n (as commanded by the CPU 50 of the intelligent box) of H-1-H-n. H stands for the Hybrid switch as shown, as an example. The H in the above references also cover latching relays such as disclosed in the present application and shown in FIGS. 2C and 2E.

The added power circuit 2VA shown in FIG. 4 is a basic circuit powered via a known mylar capacitor C4A used for AC lines for filtering or feeding small AC current to the rectifier D4A. The block diagram of FIG. 5A shows in more details the power supply for providing dual regulated DC voltages, controlled by the CPU 50 for feeding the two voltages in succession as further discussed below. FIG. 5A further shows a third or n power supply for feeding three or more voltages in succession if such feed is needed.

The regulators 1C1 and 1C2 are shown for simplicity and can be the well known single integrated circuit for outputting two or more different regulated voltages.

Alternatively, none of the regulators shown is needed. The shown V2 can be the VCC used in FIG. 4 fed by the regulator 58 and the V2A can be generated by a DC to DC converter (not shown) that is well known switching IC or a well known oscillator circuit for feeding rectified power V2A for charging the capacitor shown as C12 that is large capacitor such as 470 μF~2,000 μF to enable a discharge of 12V DC with momentary current as large as 1A~2A or more, with a charging current of, such as, 100 mA~500 mA, which will take n seconds or milli seconds to fully charge the capacitor.

The above explanation summarizes the power supply and the regulators of the needed voltages and currents of the power pulse to commensurate with the magnetic pull force to be generated by the coil 1L for actuating the relays shown in FIGS. 2C and 2E, the hybrid switches shown in FIGS. 3A-3C and any other relay or hybrid switch disclosed in the U.S. Pat. Nos. 9,036,320, 9,257,251 and 9,281,147.

The other fundamental issues for latching relays and hybrid switches are the current drain via the pole and the terminal contacts. This involves the contact's alloy and size which is not the subject of the present invention.

The other issue of fundamental importance in relays and switches structure is the speed and the force (Newton) to engage the contacts. This is commonly solved by introducing larger magnetic coils for increasing the magnetic pull force by the coil. Such solution is not always simple because of the increased size of the enclosure and the size of an electrical wall box supporting said relay or hybrid switch, that is not practical nor pleasing to architects.

The other novel solution is to feed an electric pulse combining n regulated median power sources, below V2A ad above V2 voltages, for energizing the coil in a pattern commensurate with the needed acceleration and speed to pull the armature all the way from its released to fully attracted by the coil, for engaging the contacts with the proper force as rated by the relay or the hybrid switch.

To do that the DC voltages fed to the coil may need to be well above the rated coil power (voltage and current) which is a fundamental item of magnetic coil, that is provided with a given resistance.

The resistance is a major item to define the max current drain and presents a power loss and reduces the Q factor of the coil, which affects the efficiency of the coil versus the magnetic force. For the above reason and sizes consideration the present invention preferred embodiment coil is a low voltage coil with smaller resistance and thicker winding wires as explained further below.

Another important issue is the safety matters such as UL or VDE approvals for AC power relays being installed in the public domain.

Feeding over voltages to a coil may heat the coil and cause a fire, such state cannot be allowed under any condition, be it an error by installer or malfunction in the control circuit.

For this and other reasons the present solution to power the relay coil above the rated power is by a discharged capacitor that can never be a continuous power feed of larger current than the rated current, such feed is momentary and exponentially declining, calculated to commensurate with a magnetic pull as needed, which is the other main objectives of the present invention and preferred embodiment.

The feeding of plurality of power sources in succession, such as injection via a diode, including one or more discharged power, for feeding power to generate magnetic pull commensurate with the armature physical position in motion and the magnetic pull needed for actuating the armature all way to the core, to operate a relay or an hybrid switch requiring coil with higher magnetic power, that is commonly found only in bigger coil and core sizes, is the another preferred embodiment of the present invention.

The shown power supply circuit of FIG. 5A is to power a single coil 1L, but can be made to power plurality of coils 1L one at a time as shown in FIG. 4 or all together at intervals awaiting plurality of capacitors C12 to report charge status or voltage level data via the ports I/O1-I/On of the CPU 50 shown also in FIG. 4.

The ports I/OA and I/OB connected to the VCC regulator 1C1 and the switching transistor TR1 control the feeding and switching of the VCC power or V2 to the L1 coil or to plurality of 1L coils.

The same apply to the ports I/OC and I/OD of the shown 12V regulator IC2 and the transistor TR2 for controlling and switching the 12V or the V2A for charging and discharging the charged power to the coil 1L or to plurality of 1L coils in succession or to plurality of coils each is fed with discharged capacitor 12 connected to the relay terminal TC shown in FIG. 3B, the other coil terminal is connected to the L terminal, which is the L terminal (AC live terminal) as explained below.

It is similarly simple to charge plurality of high capacity electrolytic capacitors, one for each hybrid switch or relay and discharge the capacitors simultaneously to plurality of coils 1L as required or as programmed.

It is a question of design choice. The only needed information by the CPU 50 is the status of the charged given capacitor that is fed to the CPU from each single capacitor C12 or plurality of capacitor C12 via one I/O1 port or plurality of port I/O1-I/On shown in FIG. 4.

The TL (Live AC terminal) and TN (Neutral AC terminal) and the resistor R13, the diode D13, the filter coil L2 and the filter capacitors C20 and C21 shown in FIG. 5A are typical input circuit of AC power line connected to a switching regulator for providing clean and safe rectified AC feed to a switching regulator IC. It is important to note that the circuit of the intelligent support box employs a novel concept, wherein the AC live line is connected to the circuit ground covering the entire ground pattern of the PCB of the circuits shown in FIG. 4.

Such connection enables to feed the rectified AC power via the neutral AC line. Unlike the AC live wires that feed the power selectively, the neutral AC line is commonly connected indiscriminately to the electrical outlets and appliances of a given apartment, exposed to surges and noises mixed and mingled. For this and other reasons the present control circuit uses the live line for the ground patterns. Moreover, the feeding of Neutral AC power source to the power supply circuits eliminates the problems associated with spacings, that are forcing circuit separations in the many parts and areas of a PCB, problems of which are common when the neutral AC line is the line connected to the ground surface of the PCB.

In the intelligent support box for the present application and the prior US patents and application detailed in FIG. 5A the neutral line is found in the TN terminal connected to the resistor R13 and the diode D13 with no other connections and exposures.

The C20, L2 and C21 are no longer bound by the spacing limitation with the related neutral line components occupy small space around the terminal TN and therefor are safely separated from the other elements, pattern and components of the entire circuit of FIGS. 4 and 5A.

The diode Dn connected to D10 and the power line leading to the relay coil 1L is shown with another input for connecting a given voltage V2*n* to the two voltages V2 shown as 3-5V (VCC) and to V2A shown as 12V, thereby increasing the feed voltages to operate the coil 1L to three or n. It is preferable as explained further below to have an additional power (if needed) to be discharged power and not direct feed, but this too is a design choice on a case by case basis.

As referred to above, the selected coil 1L has limited magnetic pull capacity, limited by its physical size. If the size is not an issue and the coil can be operated to actuate the latching relay or the hybrid switch by the rated voltage and current of the coil, all the above additional power supplies are not needed and are not used.

The preferable solution of present invention is for operating a given mechanical load by a force larger than the force generated by a magnetic pull of a given coil at the coil rated feed.

The coil 1L, the magnetic armature ARM-3 and the core comprising the center core 1CC and the armature support ARS which together form the well known magnetic C-core for providing magnetic pull force to the armature ARM-3.

The armature is shown in FIG. 5A to be positioned in three angles arrowed via indicators A, B, C and D.

The last shown angles C and D are the full pull position when the armature ARM-3 is closing the gap (D) with the center core 1CC, which is the fully pulled position. The fully pulled state is a short time state for the purpose of latching or releasing the pole of the relay or the hybrid switch, or as a maximum pull of the slider shoulder to the top surface BT of the bobbin as shown above in 32M of FIG. 3B.

The coil is wounded by a well known enameled winding copper wire having thicknesses ranging from 0.08 mm up to 1.0 mm or thicker diameter that are selected for a given voltage and current of choice, for a given bobbin and core sizes.

The choice is limited by the wire resistance, and the need for a given number of turns, the current drain and the voltage applied that together form the coil magnetic power and efficiency.

It is well known that high resistance reduce the coil efficiency and lower resistance reduces the voltage applied, but increases the current drain.

The preferred embodiment of the present invention choice is reduction in the resistance to improve upon the magnetic coil efficiency and provide a discharged higher voltage and diminishing current to a point as discussed further below.

Figure 5B:
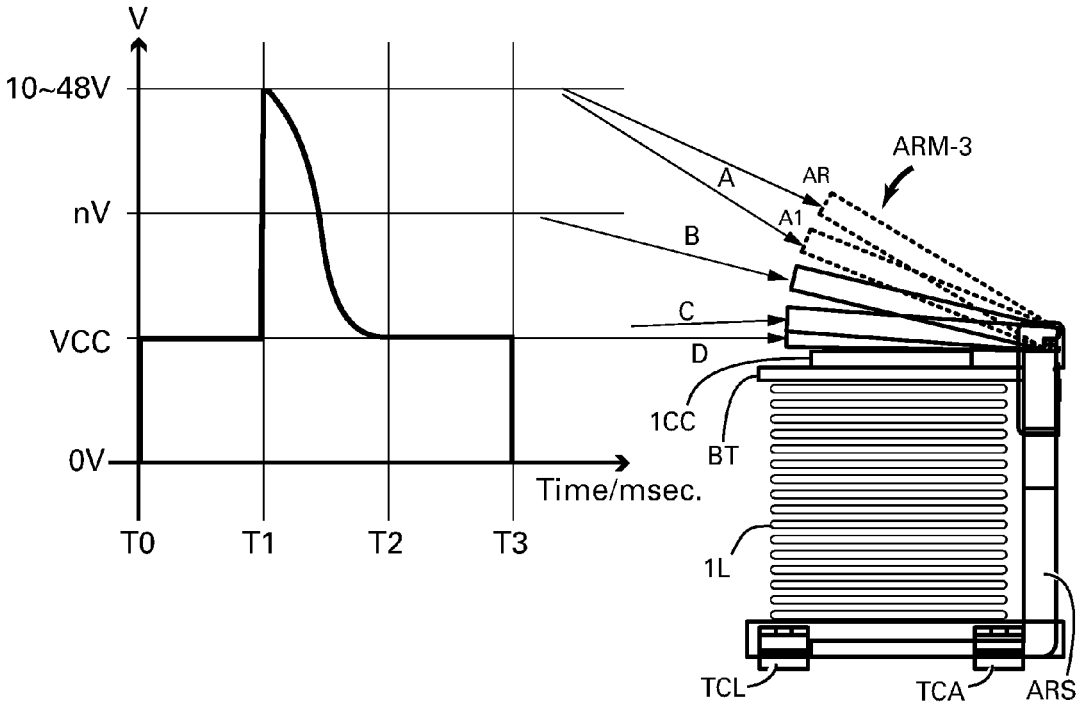
FIG. 5B is a graph showing a combination of voltages applied to the coil versus the movement in time and the electrical power needed to pull the armature to the magnetic core of the coil and to provide the initial high magnetic pull needed to pull the armature at varying gaps (distances) between the physical magnetic core of the coil and the armature.

The magnetic pull power of the coil assembly of FIG. 5B is dependent on the armature ARM-3 distance from the center core 1CC surface. The known simplified formula such as; force=1/Distance$^2$ or mass×acceleration cannot be applied to the shown assembly. The distance between the armature and the center core is not a single figure. The core is not a point of measurement and the correct force is not an issue. Moreover, the spring S4 or the two S4 springs are representing a meaningful force to overcome and the issue on hand is how to overpower the coil 1L to force the inertia and movement speed to the armature during a short pulse time to actuate the micro switch's poles to engage the other contacts, i.e., alternate or reverse the pole or poles state and latch or release the slider, during the power pulse feed lasting for a duration such as 10-20 mSec.

The power from the circuit of FIG. 5A is fed to two terminals TCL and TCA of the coil assembly 1L shown in FIG. 5B wherein TCL is the ground terminal, explained above to be the live AC line L and TCA is the DC voltage to be V2/V2A combination shown in the graph of FIG. 5B as applied between the AC live line and the DC voltage terminal.

In the shown graph of the voltage-vs-the time coordinate, the suggested values to be, for example, the 12V DC is the V2A and the VCC is for example 4V, the median value of the 3-5V shown as VCC regulated output in FIG. 5A.

The time duration could, as an example, be 5.0 mSec for each T step, T—the symbol for time constant to charge capacitor, shown in FIG. 5B as it related to the armature movement position (in mSec.).

With the above values the capacitor C12 can be, for example, 1,000 μF and the resistance of the coil 1L (rated at 4V) will be approximately 8 ohm and the 12V discharge of the capacitor to a ⅓ value (4V). The discharge is approximately calculated to be C×R×5 (5 times the C×R) for complete discharge.

Accordingly: (1,000 μF) 0.001(F)×8(R)×5(T)=40 mSec. In practice the capacitor C12 is 680~820 ρF to provide time constant (duration) to discharge down to 4V at approximately 15 mSec.

The graph of FIG. 5A shows the feeding of the VCC or the 4V to the relay via the switching transistor TR1 and via the diode D10 to the coil 1L at time T0. At the pulse initial start time the coil 1L is instantly generating magnetic pull that attract the armature ARM-3 up to the point of engaging the shoulder 32 or, if the armature is engaging the shoulder 32 the pull will cause the armature and the slider to engage the rear end of the micro switch pole at which point of time, prior to the discharging of the 12V to the coil, the generated magnetic pull force is lower than the further needed pull (the hybrid switch in its release state).

The duration of the armature ARM-3 initial movement pulled by the rated coil power cannot be calculated in precision as the positions of the armature in a released state is not defined in precision, same apply to the slider 13 and the rear end of the micro switch pole(s) that are freely released with no specific stop position or point within the release state. Yet the individual released element movement and the combined distances are a fraction of 1.0 mm.

Accordingly the initial feed of power (4V/VCC) to the coil 1L is followed by the 12V discharge from the capacitor C12 timed to provide accelerated inertia before the armature will rest i.e., before stopping the initial movement of less than 1.0 mm distance. Such initial movement within less than 1.0 mm at the rated coil voltage feed is commonly specified to be within 10-20 mSec.

It is therefore preferable and safe to switch on the transistor TR2 at a time delay T1 of 5.0 mSec, during which the armature is pulled and in motion, moving from non specified release position AR to A1. The switching on of the TR2 while TR1 is on and the armature movement is strongly accelerates (accelerating the inertia of the armature in movement) that will bring the armature (including the slider and the rear end of the micro switch poles) into position B1 in steady high speed.

The maintaining of stable high speed even though the discharged power voltage is exponentially declining is the result of the gap reduction between the armature and the magnetic core center 1CC, needing exponentially reduced force to pull the armature.

The term exponentially referred to above is not the exact term known as exponents or the power number such as "n" in $X^n$ or $Y^n$. The known graphs of the R-C charge and discharge pattern (to and from a capacitor) show the current decline during the charge time with the voltage rises and the same decline in a discharged current as the voltage decline.

The time axis graph however for the capacitor voltage discharge suggest a curve that is similar to the $2^n$ graph, accordingly the term exponential should be read as above explained, and not as the power "n" in X"$^n$"".

The injection of the higher voltage to the coil 1L after the VCC is applied is a design choice. The higher voltage can be fed from the charged capacitor as a single pulse on its own, for example 15V. The coil 1L will generate sufficient magnetic pull and operate the latching device, and will actuate the relay or the hybrid switch to alter its state.

The preferred embodiment however is to feed both voltages as explained above and further discussed below, as the applying of the VCC or the 4V and the discharged voltages via a controlled switching transistors enables to feed the coil with stabilizing power to better control the latching, the engaging of the contacts and the movement by the slider, pole(s) and the armature, preventing bouncing and chattering and guiding the lock pin to a stable position before switching the VCC off (about 30 msec.).

As the discharge voltage reaches the VCC level, no action is needed by the CPU 50 and the VCC will resume to feed its power to the coil for the trailer or the last pull of the armature (in movement) and at a distance C that is within the pull by the rated coil power feed by the VCC (4V) to engage the magnetic core center 1CC at D, for stabilizing the armature, the engagement and the latching.

The transistors TR1 and TR2 and the diodes D10 and D11 that feed the VCC and the discharge power to the coil 1L prevents reverse current in both directions between the VCC line and the charge/discharge lines. The CPU will switch off the transistor TR2 at the end of the discharge to the VCC level at T2 time shown to be a second duration of 5.0 msec.

As the coil 1L is cut from the discharge power by the switching off of TR2, the 12V regulator resume the charging of the capacitor C12, preparing for next cycle, for actuating the armature for reversing the relay or the hybrid switch of the present invention.

The repeat cycle is processed via the resistor R12 that limits the charge current to a current that cannot possibly damage the coil, in the event of malfunction or otherwise. This is regardless of the makeup of the 12V regulator circuit or IC2, and regardless if the regulator is operated by DC-DC conversion circuit, or rectified AC power line circuit as shown in FIG. 5A. The resistor R12 is the only route for the 12V to reach the coil with a current below the coil rated current.

The coil 1L rated to be 4V or 5V or 12V cannot be damaged or burned by a current that is lower than the rated current of the coil. In the example repeatedly referred to above a coil size for applying 2-3 W was selected and therefore the current drain for a 4V design will be 500~750 mA. This will mandate charging 1.5 A~2.25 A into the capacitor C12 for initial discharge. The charge current and time is a design choice.

To freshly charge 1.5~2.25 A to the capacitor C12 in one second mandates charging the full current of 1.5 A or 2.25 A. If the design choice is to charge within 3 sec. then the rated current is proper, i.e., 500 or 750 mA respectively. Moreover, in a situation such as the hybrid switch switching light on-off in residences, or the latching relays are assigned to human control, there should be no reason not to the extend the charging time to 5 sec. enabling the user to alternate or reverse the switching every five seconds.

Such charging in five seconds enables to charge C12 by 300 mA or 450 mA. This level of current (300~450 mA) is below the rated current of the coil 1L and can never cause heat that may damage the coil, the relay or the switch, in the event of malfunction. The resistor R12 selected from one of 33 or 27 ohm to limit the charge current, will further limit the coil constant drain (in the even of circuit malfunction) with a maximum current of less than 250 or 300 mA when we add the coil resistance (8-6 ohm) and a voltage of less than 2.0V to be measured onto the coil terminals. The thickness (diameter) of enameled winding wires for coil carrying 500 or 750 mA as specified must be AWG29 or 30, the thickness of which including the enameled insulation is 0.3 mm. This is of course depending on the coil bobbin and core and wire length/resistance. If the core diameter is larger and the wire length poses a higher resistance the current of 500 or 450 mA, as discussed above is not possible and thicker (larger diameter) wire is necessary.

Winding wire with 0.3 mm diameter or thicker cannot be overheated or damaged in any way by 500~750 mA current, nor by a discharge current of 1.5~2.25 Amp. for less than 5 mSec or even 10 or 20 mSec, not if the discharge is repeated every 5 sec.

With that explained, it is clear that the safety and the advantages obtain by applying the present invention to the latching relays and hybrid switches disclosed in the referenced patents and the intelligent support wall box, are clear and meaningful.

At T2 point of time the moving armature ARM-3 is at a short distance from the core 1CC that will be pulled by the rated power fed by the VCC line and the transistor TR2 is switched off, yet the transistor TR1 is maintained in its on state for the time duration leading to T3 and switch off. The T3 time duration can be 5 mSec, or longer, this too is a design choice for preventing chattering and bouncing by the contacts and giving time to the latching pin to settle in position and complete the action in a stable state.

The graph of FIG. 5B identifies the X-Y coordinates with no specific values for a good reason. The coordinates are referenced to non specified time durations and voltages pertaining coil structures and armature movements coupled with a background of different sizes, structures and combination of relays and switches.

A short study of literature or catalogues by any known relay or switch manufacturer is overwhelming with the different types, shapes categories, structures, usage and purposes with endless tables of coils and long listing of voltages for selections. The long lists and tables for selecting the voltages and current drain via the poles and contacts and the relays/switches dimensions.

Similar non defined statuses are proper in providing ranges for the coil voltages, given time (force) of the armature movements and the duration of the steps in applying the present invention to the coil as disclosed.

Another item pertaining the design choices is the applying of the actuating pulse to the coil 1L for releasing the slider 13 from a latching state. The release of the slider 13 does not involve a long push onto the rear end of the micro switch pole(s), by an armature that is partially released, i.e., the armature is resting close to the magnetic core 1CC and for releasing pin 17 into the release path the slider 13 need to be pushed to a distance that is a fraction of 1.0 mm (0.3-0.4 mm).

The action needed to release the latched slider does not require the three steps of FIG. 5B, a single VCC step will be sufficient to pull the armature ARM-3 shown in 32P of FIG. 3B to be in its partial release state. The movement needed to release the pin 17 from its lock point into the release indentation path (some 0.4 mm distance) that is pushed all the way in the opposite direction to somewhere within the release area of FIG. 2A by the rear end of the poles MC1 and/or MC2 reversely actuated by the spring(s) S4.

The release is a propelled action outside the armature limitation. The armature engagement is to release the pin 17 from its position by pushing the slider 0.4 mm or less.

The design choice here is the introduction of two different actuation pulse, one for lock and the other for the release which mandates further programming including the verifying of the current state at the time of actuation, that cannot be based on the last operated status by a command. A stored data must include data of manually operated hybrid switch as well. Therefore, a decision to use identical pulse or different power pulse i.e., the two options, are fully implementable via the CPU of the intelligent support box and can be applied, this however as stated is a design choice as no damage or costs are involved in applying the same three step pulse to the release action.

The design choice may be different for latching relay that operates by commands only (no finger push of a manual switch involved). The CPU can very simply memorize the last command and also be fed with statuses data (current, voltages level) and generate different pulse to latch and release the relay in running operation.

The relays and hybrid switches of FIGS. 2A-3C are shown to be plug-in type because the connecting terminals TL, T2, TC, T1A-T2-A and T1 all suggest or implies plug-in terminal.

Though not shown in the present application the relays and the switches can be provided with screw terminals, wire push terminals, solder terminals, crimp terminals and many other connecting terminals including solder terminals for mounting the relay or the switches or both onto PCB.

Moreover, the disclosure of the circuits of FIGS. 4 and 5A refers to a support electrical box to operate the relays and the hybrid switches. However it should be obvious that the circuits involved can be built into an hybrid switch or a relay enclosure for including the control and operate circuits, or such circuits can be connected directly to the relay or the hybrid switch, or part of the circuit can be incorporated into the casing of the relay and/or the hybrid switch.

Similarly many different small size up to very big size relays can use the guided lock pin of the present invention and use it with built in control circuit or connected to a control circuit, local or remote. The many or the few signal relays that occupy small or large scale communication equipment and PCBs can all be operated by an efficient power (current and voltages) with a single voltage pulse or combinations of voltages included within the pulse feed by a given design choices.

All such relays be it for heavy power feed such as used by MPDT or MPST or for small signal operation, can benefit greatly from the present invention, and should be covered and bound by the limit of the claims as filed. The disclosed powering of the coil is particularly important for such application as feeding power pluse to actuate increase number of micro switches in the relay or the hybrid switch of the present invention.

It should be obvious from all the above that the many items for simplifying and improving the structure of the latching mechanism, reducing the number of elements used and substantially and meaningfully reducing the power needed to actuate the armature of the latching relays and hybrid switches, and further teaching an inventive, simple method to enable the reduction in the size of a coil operating the latching relays and hybrid switches and thereby reducing the overall size and cost of the mechanically latched relays and hybrid switches.

It should be understood, of course, that the foregoing disclosure relates to only a preferred embodiment of the invention and that it is intended to cover all changes and modifications of the example of the invention herein chosen for the purpose of the disclosure, which modifications do not constitute departures from the scope of the invention.

What is claimed is:

1. A latching device comprising a springy lock pin, a slider with indentation path for guiding said springy lock pin and a track for said slider, said latching device extends from one of an armature and at least one springy pole to one of a base and a body containing one of a structured relay and an hybrid switch for alternating the state of said slider and said at least one springy pole from latch to release and from release to latch by at least one of a pull of said armature by a voltage rated magnetic coil fed with said rated voltage pulse and a manual push of said slider via a plunger;

said slider maintains one of engaging and disengaging state of at least one first contact with a single throw contact of said at least one springy pole and one of engaging dual throw contact of said at least one springy pole with said at least one first contact and alternately engaging said dual throw contact with at least one second contact by one of each said pull and push during each said latch and release state respectively;

said springy lock pin exerts minute guiding force onto said indentation path and said at least one springy pole reversely propels and pushes said slider by exerting negligible push back force onto said slider to reversely guide the springy lock pin into a latch state and said slider into one of partial release and full release state thereby enabling said engaging of said contact of at least one springy pole with said one of first and second contact by a magnetic pull force commensurate with said rated voltage pulse needed to actuate said armature including said minute guiding force by said springy lock pin onto said indentation path and a negligible force to move said slider;

wherein when said at least one springy pole and said contacts are structured for an increased force of said engaging for handling higher electrical current and said rated voltage pulse is increased to increase the magnetic pull force generated by said magnetic coil; and wherein an associated electrical circuit for feeding said magnetic coil with said rated voltage pulse is augmented with at least one electrical feed source with higher voltage for charging a capacitor for augmenting said rated voltage pulse by timely injecting discharged higher voltage into said pulse thereby generating a combination pulse comprising an initial feed at the rated voltage followed by said higher voltage that is exponentially declining in a discharge pattern of higher voltage and current commensurate with the armature accelerated movement by closing the trailing magnetic gap at higher speed forcing the armature all the way to engage the magnetic core timed with the discharged voltage feed decline, down to one of the rated voltage and below.

2. The latching device according to claim 1, wherein said relay and said hybrid switch are selected from a group comprising single pole single throw (SPST), single pole dual throw (SPDT), dual poles single throw (DPST), dual poles dual throw (DPDT), reversing DPDT, three and more (multi) poles single throw (MPST) and multi poles dual throw (MPDT); and said state of said one of relay and an hybrid switch is selected from a group comprising switch on, switch over, switch off, switch from cross to straight and switch from straight to cross by engaging said at least one pole with said at least one said first contact and at least one second contact including no contact respectively.

3. The latching device according to claim 1, wherein the partial release and the full release movement of said pole forces micro movement between the contacts of said at least one pole and said one of first contact and second contact for wiping said contacts from electrical blemishes.

4. The latching device according to claim 1, wherein said one of relay and hybrid switch is structured to maintain said engagement through and after said latching with said one of first and second contact by a springy element selected from a group comprising springy structured pole, a micro switch pole, an elongated pole, a spring driven pole, a springy structured said one of first and second contact, a spring driven said one of first and second contact and combinations thereof.

5. The latching device according to claim 1 wherein said hybrid switch further including a key for pushing said plunger for enabling said engagement of said at least one pole by one of said pull and a push by said key.

6. The latching device according to claim 1, wherein said one of relay and hybrid switch is enclosed in a casing with connection terminals and pins selected from a group comprising at least one of plug in pins and terminals into receptacle sockets, at least one of plug in terminals, pins and sockets for mating with reciprocal sockets, pins and terminals, solder terminals, wire terminal for wire attachment selected from a group comprising screw terminals, wire push terminals, wrapping terminals and combinations thereof.

7. The latching device according to claim 1 wherein said minute guiding force and said negligible force range preferably below 0.1 newton and said increase engagement force is above 0.7 newton.

8. The latching device according to claim 7 wherein said combination pulse is further augmented by at least one median discharged voltage to widen the exponential curve thereby lengthen the feed time of the discharged voltage to commensurate with the accelerated speed and trailing distance for the armature to fully engage the magnetic core.

9. The latching device according to claim 8 wherein said discharged voltage declining all the way down to the rated voltage is augmented by a trailer of said rated voltage for stabilizing said latching and said engaging.

10. The latching device according to claim 7, wherein said relay and said hybrid switch are selected from a group comprising single pole single throw (SPST), single pole dual throw (SPDT), dual poles single throw (DPST), dual poles dual throw (DPDT), reversing DPDT, three and more (multi) poles single throw (MPST) and multi poles dual throw (MPDT); and said state of said one of relay and an hybrid switch is selected from a group comprising switch on, switch over, switch off, switch from cross to straight and switch from straight to cross by engaging said at least one pole with said at least one said first contact and at least one second contact including no contact respectively.

11. The latching device according to claim 7, wherein said one of relay and hybrid switch is structured to maintain said engagement through and after said latching with said one of first and second contact by a springy element selected from a group comprising springy structured pole, a micro switch pole, an elongated pole, a spring driven pole, a springy structured said one of first and second contact, a spring driven said one of first and second contact and combinations thereof.

12. The latching device according to claim 7, wherein said one of relay and hybrid switch is enclosed in a casing with connection terminals and pins selected from a group comprising at least one of plug in pins and terminals into receptacle sockets, at least one of plug in terminals, pins and sockets for mating with reciprocal sockets, pins and terminals, solder terminals at least one of wire terminal for wire attachment selected from a group comprising screw terminals, wire push terminals, wrapping terminals and combinations thereof.

13. A method for latching one of single throw and dual throw pole contact of at least one springy pole included in one of a relay and an hybrid switch for maintaining one of engaging and disengaging state of at least one first contact with said pole contact by a latching device comprising a springy lock pin exerting minute force, a slider with indentation path for guiding said springy lock pin and a track for said slider, said latching device is extended from one of an armature and said at least one springy pole to one of a base and a body of said one of a relay and hybrid switch, said springy pole is guided by said slider movement propelled by negligible force exerted by one of a pull by a voltage rated magnetic coil and a push by a plunger, said method comprising the steps of:

a. exerting one of said pull and said push at a force commensurate with one of said magnetic pull force generated by said coil fed with said rated voltage pulse and by a human finger respectively to include actuating said at least one springy pole, said minute force exerted by said springy lock pin and a negligible force for propelling and moving said slider position;

b. alternating said slider position propelled via one of said pull and push from release position to a latch position including partial release for one of said engaging and disengaging of said at least one pole contact with said at least one first contact and one of said at least one second contact and no contact;

c. maintaining said one of said release and said partial release state of said slider for maintaining said one of engage and one of disengage and alternate said contact of said pole awaiting a fresh said one of pull and push.

14. The method according to claim 13, wherein said relay and said hybrid switch are selected from a group comprising single pole single throw (SPST), single pole dual throw (SPDT), dual poles single throw (DPST), dual poles dual throw (DPDT), reversing DPDT, three and more (multi) poles single throw (MPST) and multi poles dual throw (MPDT); and said state of said one of relay and an hybrid switch is selected from a group comprising switch on, switch over, switch off, switch from cross to straight and switch from straight to cross by engaging said at least one pole with said at least one said first contact and at least one second contact including no contact respectively.

15. The method according to claim 13, wherein the partial release and the full release movement of said pole forces micro movement between the contacts of said at least one pole and said one of first contact and second contact for wiping said contacts from electrical blemishes.

16. The method according to claim 13, wherein said one of relay and hybrid switch is structured to maintain said engagement through and after said latching with said one of first and second contact by a springy element selected from a group comprising springy structured pole, a micro switch pole, an elongated pole, a spring driven pole, a springy structured said one of first and second contact, a spring driven said one of first and second contact and combinations thereof.

17. The method according to claim 13 wherein said hybrid switch further including a key for pushing said plunger for enabling said engagement of said at least one pole by one of said pull and a push by said key.

18. The method according to claim 13, wherein said one of relay and hybrid switch is enclosed in a casing with connection terminals and pins selected from a group comprising at least one of plug in pins and terminals into receptacle sockets, at least one of plug in terminals, pins and sockets for mating with reciprocal sockets, pins and terminals, solder terminals, wire terminal for wire attachment selected from a group comprising screw terminals, wire push terminals, wrapping terminals and combinations thereof.

19. The method according to claim 13 wherein said at least one springy pole is one of structured by and include a stronger spring for engaging said at least one of first and second contact with a stronger force for handling higher electrical current and said rated voltage pulse is augmented to increase the magnetic pull force generated by said magnetic coil at said rated voltage; and wherein an associated electrical circuit for feeding said magnetic coil with said rated voltage pulse is augmented with at least one electrical feed source with higher voltage for charging a capacitor for augmenting said rated voltage pulse by timely injecting discharged higher voltage into said pulse thereby generating a combination pulse comprising an initial feed at the rated voltage followed by said higher voltage that is exponentially declining in a discharge pattern of higher voltage and current commensurate with the armature accelerated movement by closing the trailing magnetic gap at higher speed forcing the armature all the way to engage the magnetic core timed with the discharged voltage feed decline, down to one of the rated voltage and below.

20. The method according to claim 19 wherein said combination pulse is further augmented by at least one median discharged voltage to widen the exponential curve thereby lengthen the feed time of the discharged voltage to commensurate with the accelerated speed and trailing distance for the armature to fully engage the magnetic core.

21. The latching device according to claim 20 wherein said discharged voltage declining all the way down to the rated voltage is augmented by a trailer of said rated voltage for stabilizing said latching and said engaging.

22. The latching device according to claim 19, wherein said relay and said hybrid switch are selected from a group comprising single pole single throw (SPST), single pole dual throw (SPDT), dual poles single throw (DPST), dual poles dual throw (DPDT), reversing DPDT, three and more (multi) poles single throw (MPST) and multi poles dual throw (MPDT); and said state of said one of relay and an hybrid switch is selected from a group comprising switch on, switch over, switch off, switch from cross to straight and switch from straight to cross by engaging said at least one pole with said at least one said first contact and at least one second contact including no contact respectively.

23. The method according to claim 19, wherein said one of relay and hybrid switch is structured to maintain said engagement through and after said latching with said one of first and second contact by a springy element selected from a group comprising springy structured pole, a micro switch pole, an elongated pole, a spring driven pole, a springy structured said one of first and second contact, a spring driven said one of first and second contact and combinations thereof.

24. The method according to claim 19, wherein said one of relay and hybrid switch is enclosed in a casing with connection terminals and pins selected from a group comprising at least one of plug in pins and terminals into receptacle sockets, at least one of plug in terminals, pins and sockets for mating with reciprocal sockets, pins and terminals, solder terminals, wire terminal for wire attachment selected from a group comprising screw terminals, wire push terminals, wrapping terminals and combinations thereof.

* * * * *